US010405602B2

(12) United States Patent
Laframboise et al.

(10) Patent No.: US 10,405,602 B2
(45) Date of Patent: Sep. 10, 2019

(54) INSOLE FOR SPORT FOOTWEAR

(71) Applicant: CORRECT MOTION INC., Montréal (CA)

(72) Inventors: Steve Laframboise, Terrebonne (CA); John Moshopoulos, Laval (CA)

(73) Assignee: CORRECT MOTION INC., Montréal (CA)

( * ) Notice: Subject to any disclaimer, the term of this patent is extended or adjusted under 35 U.S.C. 154(b) by 12 days.

(21) Appl. No.: 15/110,732

(22) PCT Filed: Aug. 21, 2014

(86) PCT No.: PCT/CA2014/000654

§ 371 (c)(1),
(2) Date: Jul. 9, 2016

(87) PCT Pub. No.: WO2015/106334

PCT Pub. Date: Jul. 23, 2015

(65) Prior Publication Data

US 2016/0360827 A1 Dec. 15, 2016

Related U.S. Application Data

(60) Provisional application No. 61/928,544, filed on Jan. 17, 2014.

(51) Int. Cl.
*A43B 17/02* (2006.01)
*A43B 7/24* (2006.01)
(Continued)

(52) U.S. Cl.
CPC ..... *A43B 7/24* (2013.01); *A43B 5/002* (2013.01); *A43B 5/0405* (2013.01);
(Continued)

(58) Field of Classification Search
CPC ..... A43B 7/24; A43B 7/141; A43B 7/142; A43B 7/1425; A43B 7/144; A43B 7/1405;
(Continued)

(56) References Cited

U.S. PATENT DOCUMENTS 1,958,097 A * 5/1934 Shaw ..... A43B 7/1415 36/144
2,051,072 A * 8/1936 Brown ..... A43B 7/1445 36/173
(Continued)

FOREIGN PATENT DOCUMENTS

| | | |
|---|---|---|
| AU | 2012261588 | 6/2013 |
| WO | 2006068513 | 6/2006 |
| WO | 2016054737 | 4/2016 |

OTHER PUBLICATIONS

English Abstract of JP2010155009(A), "Insole for Golf Shoe", published on Jul. 15, 2010.
(Continued)

*Primary Examiner* — Jameson D Collier
*Assistant Examiner* — Heather N Mangine
(74) *Attorney, Agent, or Firm* — Bereskin & Parr LLP/S.E.N.C.R.L., s.r.l.

(57) ABSTRACT

There is provided an insole for a sport footwear, the insole comprises: a forefoot portion comprising an incliner for inclining a foot of a wearer towards an outer side of the insole, a midfoot portion having an arch extending from an underside of the insole, and a rearfoot portion comprising an incliner for inclining the foot of the wearer towards the outer side of the insole. Such an insole can be effective for maintaining a linear motion of the knee of the user. Moreover such an insole can be effective for maintaining the foot of the person inclined outwardly. Thus, the body weight of
(Continued)

the person can also be shifted outwardly, which improves balance.

10 Claims, 9 Drawing Sheets

(51) Int. Cl.

| | |
|---|---|
| ***A43B 7/14*** | (2006.01) |
| ***A43B 7/16*** | (2006.01) |
| ***A43B 5/00*** | (2006.01) |
| ***A43B 5/04*** | (2006.01) |
| ***A43B 5/06*** | (2006.01) |
| ***A43B 5/16*** | (2006.01) |

(52) U.S. Cl.
CPC ..... *A43B 5/0411* (2013.01); *A43B 5/06* (2013.01); *A43B 5/1641* (2013.01); *A43B 7/141* (2013.01); *A43B 7/142* (2013.01); *A43B 7/144* (2013.01); *A43B 7/1425* (2013.01); *A43B 7/1445* (2013.01); *A43B 7/16* (2013.01); *A43B 17/023* (2013.01)

(58) Field of Classification Search
CPC ..... A43B 7/1465; A43B 17/023; A43B 7/16; A43B 7/1415; A43B 7/14; A43B 17/02
USPC ..... 36/43, 44, 140, 142, 143, 144, 145
See application file for complete search history.

(56) References Cited

U.S. PATENT DOCUMENTS 2,097,959 A * 11/1937 Whitman ..... A43B 7/142 36/159
2,217,990 A * 10/1940 Nussbaum ..... A43B 7/142 36/11.5
2,616,190 A * 11/1952 Darby ..... A43B 7/14 36/144
3,339,555 A * 9/1967 Rotko ..... A43B 7/1465 36/165
3,828,792 A * 8/1974 Valenta ..... A43B 7/14 36/178
3,990,159 A * 11/1976 Borgeas ..... A43B 7/28 36/101
4,180,924 A 1/1980 Subotnick
4,266,553 A * 5/1981 Faiella ..... A43B 7/141 36/144
4,268,980 A * 5/1981 Gudas ..... A43B 3/18 36/37
4,517,981 A * 5/1985 Santopietro ..... A43B 7/14 36/140
4,682,425 A * 7/1987 Simmons ..... A43B 17/02 36/127
4,685,227 A * 8/1987 Simmons ..... A43B 17/02 36/127
4,702,255 A * 10/1987 Schenkl ..... A43B 7/141 36/145
4,769,926 A * 9/1988 Meyers ..... A43B 5/00 36/154
5,138,774 A * 8/1992 Sarkozi ..... A43B 7/14 36/159
5,174,052 A 12/1992 Schoenhaus et al.
5,187,885 A * 2/1993 Murphy ..... A43B 5/001 36/127
5,327,663 A * 7/1994 Pryce ..... A43B 7/141 36/140
5,345,701 A * 9/1994 Smith ..... A43B 7/24 36/127
5,572,805 A * 11/1996 Giese ..... A43B 13/12 36/103
5,611,153 A * 3/1997 Fisher ..... A43B 7/14 36/173
5,685,092 A * 11/1997 Prieskorn ..... A43B 7/144 36/43
5,842,294 A * 12/1998 Fabricant ..... A43B 7/14 36/127
6,092,314 A * 7/2000 Rothbart ..... A43B 7/141 36/140
6,205,685 B1 * 3/2001 Kellerman ..... A43B 1/0072 36/160
6,253,469 B1 * 7/2001 Atlani ..... A43B 7/142 36/140
6,301,805 B1 * 10/2001 Howlett ..... A43B 7/142 36/145
6,442,875 B1 9/2002 Joubert et al.
6,536,137 B1 * 3/2003 Celia ..... A43B 1/0045 36/28
6,598,319 B2 * 7/2003 Hardt ..... A43B 7/142 36/153
7,360,326 B1 * 4/2008 Tanaka ..... A61F 5/14 36/144
7,849,610 B2 * 12/2010 Clough ..... A61F 5/14 36/140
8,356,427 B2 * 1/2013 Svae ..... A43B 7/1425 36/140
9,167,864 B1 * 10/2015 Piontkowski ..... A43B 1/0054
9,655,404 B2 * 5/2017 Wakeland ..... A43B 13/386
2001/0027583 A1 10/2001 Rothbart
2003/0093920 A1 5/2003 Greene et al.
2003/0093923 A1 5/2003 Joubert et al.
2005/0039349 A1 * 2/2005 Grisoni ..... A43B 7/1425 36/71
2005/0166423 A1 * 8/2005 Norton ..... A43B 13/04 36/28
2006/0059726 A1 * 3/2006 Song ..... A43B 7/142 36/142
2006/0288613 A1 * 12/2006 Lo ..... A43B 7/1415 36/44
2007/0107263 A1 * 5/2007 Lopez ..... A43B 7/144 36/71
2008/0060229 A1 * 3/2008 Epstein ..... A43B 7/16 36/159
2009/0084000 A1 * 4/2009 Pai ..... A43B 7/142 36/91
2010/0154252 A1 * 6/2010 Avent ..... A43B 7/14 36/91
2010/0236096 A1 9/2010 Pauk et al.
2010/0263231 A1 * 10/2010 Smirman ..... A43B 5/1641 36/43
2011/0083345 A1 * 4/2011 Santopietro ..... A43B 7/141 36/180
2012/0055045 A1 * 3/2012 Wang ..... A43B 7/1425 36/88
2012/0159814 A1 6/2012 Smith et al.
2012/0210605 A1 * 8/2012 Riley ..... A43B 3/108 36/91
2012/0227285 A1 9/2012 Adair et al.
2013/0067764 A1 * 3/2013 Riddle ..... A43B 7/142 36/31
2013/0133223 A1 * 5/2013 Zake ..... A43B 13/18 36/28
2013/0227859 A1 * 9/2013 Takayama ..... A43B 7/141 36/88
2013/0333249 A1 * 12/2013 Guer ..... A43B 3/246 36/134
2013/0340281 A1 12/2013 Gossman
2014/0245631 A1 * 9/2014 Joseph ..... A43B 1/0027 36/44
2014/0298600 A1 * 10/2014 Smirman ..... A43B 7/1425 12/142 R
2014/0298682 A1 * 10/2014 Cavanagh ..... A43B 13/386 36/44
2015/0047226 A1 2/2015 Smirman
2015/0068059 A1 * 3/2015 Kinchington ..... A43B 7/26 36/11.5
2015/0196086 A1 * 7/2015 Riddle ..... A43B 7/142 36/25 R

(56) References Cited

U.S. PATENT DOCUMENTS

| | | | | |
|---|---|---|---|---|
| 2015/0282558 | A1* | 10/2015 | Rawls-Meehan | A43B 3/0057 36/31 |
| 2015/0342295 | A1* | 12/2015 | Moon | A43B 7/24 36/43 |
| 2016/0150854 | A1* | 6/2016 | Hockerson | A43B 13/186 36/28 |
| 2016/0213094 | A1* | 7/2016 | Matsui | A43B 7/28 |
| 2017/0027277 | A1* | 2/2017 | Anthony | A43B 7/28 |
| 2017/0035142 | A1* | 2/2017 | Tu | A43B 7/28 |
| 2017/0112231 | A1* | 4/2017 | Torrance | A43B 3/0031 |

OTHER PUBLICATIONS

English Abstract of WO2011159007(A1), "Shoe Capable of Improving Brain Function Through Stimulation of Proprioceptors", published on Dec. 22, 2011.

Morton Foot, "Supination Control", [online], [retrieved on Jan. 5, 2017]. Retrieved from the Internet URL:http://www.mortonfoot.com/supination.html.

ProKinetics, "Natural Body Balance TM—Replacement Insoles", [online], [retrieved on Jan. 5, 2017]. Retrieved from the Internet URL:http://www.prokinetics.com/products/natural-body-halance-replacement-insoles>.

English Abstract of FR2844995(A1), "Orthopedic insole comprises a unitary structure with elevated internal and external correcting elements made of a hot-molded material of defined density and hardness", published on Apr. 2, 2004.

* cited by examiner

INSOLE FOR SPORT FOOTWEAR

CROSS-REFERENCE TO RELATED APPLICATIONS

The present application is a 35 USC 371 national stage entry of PCT/CA2014/000654 filed on Aug. 21, 2014 and which claims priority on U.S. 61/928,544 filed on Jan. 17, 2014. These documents are hereby incorporated by reference in their entirety.

FIELD OF THE DISCLOSURE

The present disclosure relates an insole for sport footwear. In particular, the present disclosure relates to an insole for inclining a foot of a wearer or promoting supination of a foot of a wearer.

BACKGROUND OF THE DISCLOSURE

Insoles for footwear to be worn for walking or running are typically intended to providing a flat foot bed. Such insoles aim to correct under or over pronating or supinating of the foot when carrying out a walking or running motion. Providing a flat foot bed may help a wearer's posture, reduce risk of injury and/or reduce uneven wear of the footwear. However, such insoles may not be well-suited for sports or activities that require a motion of the foot and/or leg that does not closely resemble a walking or running motion.

SUMMARY OF THE DISCLOSURE

It would thus be highly desirable to be provided with an apparatus or a method that would at least partially solve one of the problems previously mentioned or that would be an alternative to the existing technologies.

According to one aspect, there is provided an insole for a sport footwear, the insole comprising: a forefoot portion comprising an incliner for inclining a foot of a wearer towards an outer side of the insole, a midfoot portion having an arch extending from an underside of the insole, and a rearfoot portion comprising an incliner for inclining the foot of the wearer towards the outer side of the insole.

According to another aspect, there is provided an insole for a sport footwear, the insole comprising a forefoot portion comprising an incliner for promoting supination of a foot of a wearer, a midfoot portion having an arch extending from an underside of the insole; and a rearfoot portion comprising an incliner for promoting supination of the foot of the wearer.

According to another aspect, there is provided an insole for a sport footwear, the insole comprising a forefoot portion comprising an incliner, wherein a thickness of an inner side of the forefoot portion is greater than a thickness of an outer side of the forefoot portion, a midfoot portion having an arch extending from an underside of the insole; and a rearfoot portion comprising an incliner, wherein a thickness of an inner side of the rearfoot portion is greater than a thickness of an outer side of the rearfoot portion.

According to another aspect, there is provided an insole for sport footwear, the insole comprising a forefoot portion being partially tapered from an inner side of the insole towards an outer side of the insole, a midfoot portion having an arch extending from an underside of the insole, a thickness of an inner side of the midfoot portion being greater than a thickness of an outer side of the midfoot portion; and a rearfoot portion being partially tapered from the inner side of the insole towards the outer side of the insole.

According to another aspect, there is provided an insole for an ice skate, the insole comprising a forefoot portion comprising an incliner for inclining a foot of a wearer towards an outer side of the insole, a midfoot portion having an arch extending from an underside of the insole; and a rearfoot portion comprising an incliner for inclining the foot of the wearer towards the outer side of the insole.

According to another aspect, there is provided an insole for an ice skate, the insole comprising a forefoot portion comprising an incliner for promoting supination of a foot of a wearer, a midfoot portion having an arch extending from an underside of the insole; and a rearfoot portion comprising an incliner for promoting supination of the foot of the wearer.

According to another aspect, there is provided an insole for a an ice skate, the insole comprising a forefoot portion comprising an incliner, wherein a thickness of an inner side of the forefoot portion is greater than a thickness of an outer side of the forefoot portion, a midfoot portion having an arch extending from an underside of the insole and a rearfoot portion comprising an incliner, wherein a thickness of an inner side of the rearfoot portion is greater than a thickness of an outer side of the rearfoot portion.

According to another aspect, there is provided an insole for an ice skate, the insole comprising a forefoot portion being partially tapered from an inner side of the insole towards an outer side of the insole, a midfoot portion having an arch extending from an underside of the insole, a thickness of an inner side of the midfoot portion being greater than a thickness of an outer side of the midfoot portion and a rearfoot portion being partially tapered from the inner side of the insole towards the outer side of the insole.

BRIEF DESCRIPTION OF THE DRAWINGS

The following drawings represent examples that are presented in a non-limitative manner.

DETAILED DESCRIPTION OF THE DISCLOSURE

Figure 1A:
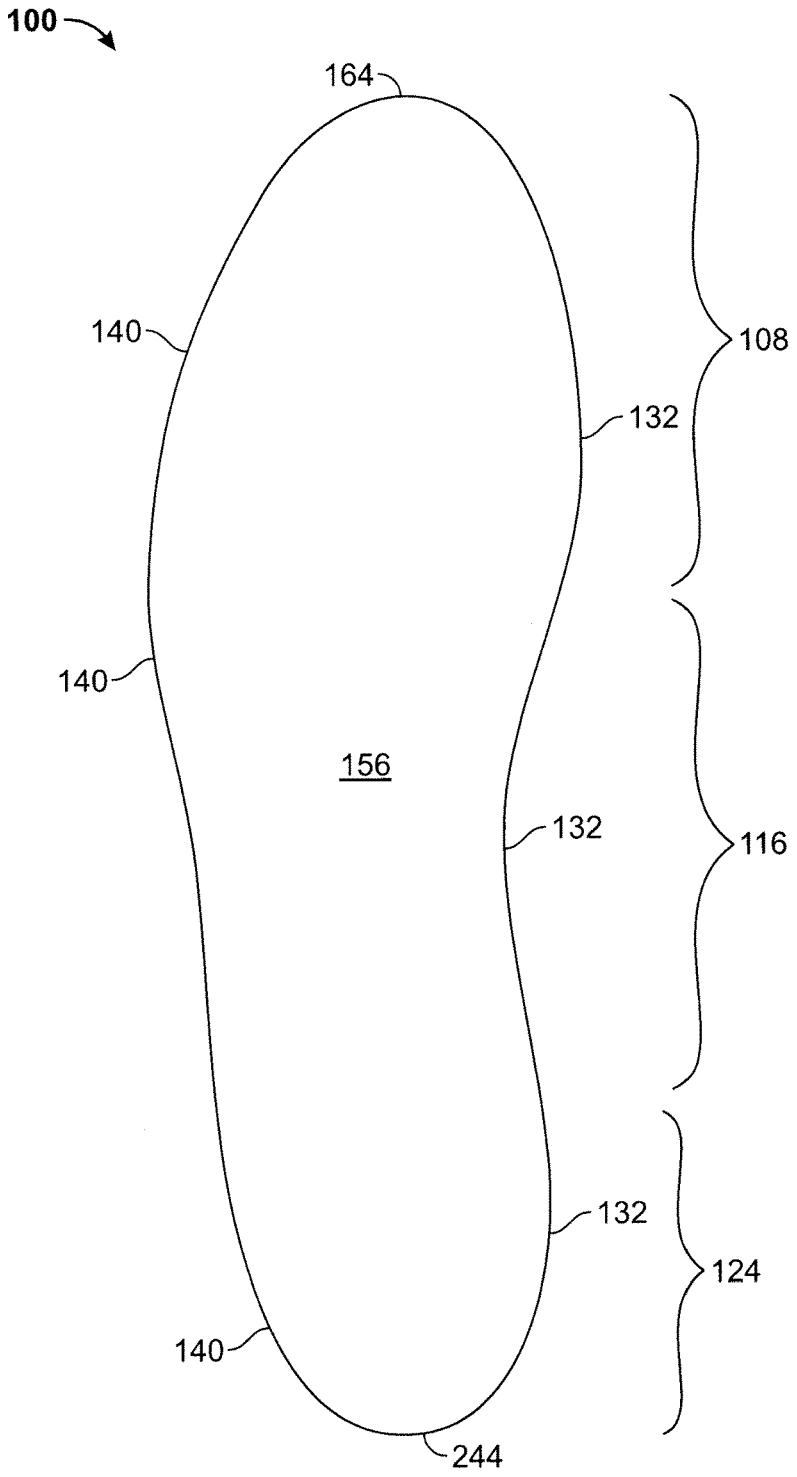
FIG. 1A illustrates a top view of an insole according to various exemplary embodiments.

The following examples are presented in a non-limitative manner.

It has been observed that when a person is participating in particular types of sports, the movement of a person's leg and/or feet will be different from the leg and/or feet movement of a typical walking/running action. In a typical walking/running action, a person's knee makes a circular motion. For example, in a walking/running action, the foot reaches a supination stance at the arch and subsequently rolls towards the big toe, thereby forming the circular motion.

By contrast, it may be beneficial in some sports for the person's knee to move in a substantially linear (substantially non-circular) manner. These sports include skating, alpine skiing and cross-country skiing. For example, these sports often require the person to balance his or her weight on a single leg. This balancing is facilitated when the knee maintains a substantially linear movement. In such sports, the circular motion made during walking/running may be undesirable, and participants in these sports overtie their footwear so as to reduce or prevent the flex that would result in the undesirable circular motion. For example, making the circular motion would cause the participant to lose their balance.

It has been further observed that linear motion of the knee and balancing on a single leg is further facilitated when at least one foot of the person is inclined outwardly. In inclining thusly, the body weight of the person is also shifted outwardly, which improves balance. For example, the center of mass/gravity of the person is aligned with the person's grounded foot.

The expression "front" as used herein with respect to an insole or a foot refers to a region that generally corresponds to the toes or forefoot direction of the foot when the wearer's foot is received in the insole.

The expression "rear" as used herein with respect to an insole or a foot refers to a region that generally corresponds to the heel or rearfoot direction of the foot when the wearer's foot is received in the insole.

The expression "inner side" as used herein with respect to an insole refers to a region that generally corresponds to the inner side of the foot (ex: hallux, medial cuneiform, etc.) when the foot is received in the insole.

The expression "outer side" as used herein with respect to an insole refers to a region that generally corresponds to the outer side of the foot (ex: fifth phalanx, fifth metatarsal, cuboid) when the wearer's foot is received in the insole.

The expression "taper" or variant thereof as used herein with respect to an insole or portions thereof refers to a decreasing thickness of the insole or the portions thereof. For example, when tapering from a position A to a position B, the thickness decreases from the position A to the position B.

For example, according to insoles of the present disclosure, the incliner of the forefoot portion comprises an at least partially tapered portion from an inner side of the insole towards an outer side of the insole.

For example, according to insoles of the present disclosure, the at least partially tapered portion of the forefoot portion is spaced apart from a front end of the insole.

For example, according to insoles of the present disclosure, the at least partially tapered portion of the forefoot portion extends from the inner side of the insole to a location intermediate the inner side and the outer side.

For example, according to insoles of the present disclosure, the incliner of the forefoot portion comprises a wedge provided on an underside of the insole proximate to an inner side of the insole.

For example, according to insoles of the present disclosure, the wedge is tapered towards an outer side of the insole.

For example, according to insoles of the present disclosure, the wedge is further tapered towards the front end of the insole.

For example, according to insoles of the present disclosure, the wedge is integrally formed within the underside of the insole.

For example, according to insoles of the present disclosure, the wedge is connected to the underside of the insole.

For example, according to insoles of the present disclosure, a thickness of a proximal hallux portion of the forefoot portion is greater than a thickness of a distal hallux portion of the forefoot portion.

For example, according to insoles of the present disclosure, a thickness of a distal hallux portion of the forefoot portion is substantially equal to a thickness of a distal fifth phalanx portion of the forefoot portion.

For example, according to insoles of the present disclosure, the arch defines a recess on the underside of the insole, the recess extending from the inner side to a second location intermediate the inner side and the outer side.

For example, according to insoles of the present disclosure, the recess is adapted to receive a protruding arch of the sport footwear.

For example, according to insoles of the present disclosure, a height of a first metatarsal portion of the midfoot portion is greater than a height of a fifth metatarsal portion of the midfoot portion.

For example, according to insoles of the present disclosure, a height of a first metatarsal portion, a height of a second metatarsal portion and a height of a third metatarsal portion are each greater than a height of a fifth metatarsal portion of the midfoot portion.

For example, according to insoles of the present disclosure, the height of the inner side of the midfoot portion is greater than a height of an inner side of the forefoot portion.

For example, according to insoles of the present disclosure, a thickness of an inner side of the rearfoot portion is greater than a thickness of a hallux portion of the forefoot portion.

For example, according to insoles of the present disclosure, the incliner of the rearfoot portion comprises an at least partially tapered portion from an inner side of the insole towards an outer side of the insole.

For example, according to insoles of the present disclosure, an outer side of the rearfoot portion is tapered from a rear end of the insole towards the front end of the insole.

For example, according to insoles of the present disclosure, the incliner of the rearfoot portion comprises a wedge provided on an underside of the insole proximate to an inner side of the insole.

For example, according to insoles of the present disclosure, the wedge is tapered towards an outer side of the insole.

For example, according to insoles of the present disclosure, the wedge is further tapered towards the front end of the insole.

For example, according to insoles of the present disclosure, wherein the wedge is integrally formed within the underside of the insole.

For example, according to insoles of the present disclosure, the wedge is connected to the underside of the insole.

For example, according to insoles of the present disclosure, wherein the sport footwear is a skate.

For example, according to insoles of the present disclosure, the sport footwear is an ice skate.

For example, according to insoles of the present disclosure, the ice skate is chosen from a figure skate, a hockey skate, and a speed skate.

For example, according to insoles of the present disclosure, the sport footwear is a chosen from a running shoe, a hiking boot, an alpine ski boot, a cross-country ski boot and a skate.

For example, according to insoles of the present disclosure, the recess is adapted to receive a protruding arch of the ice skate.

Figure 1B:
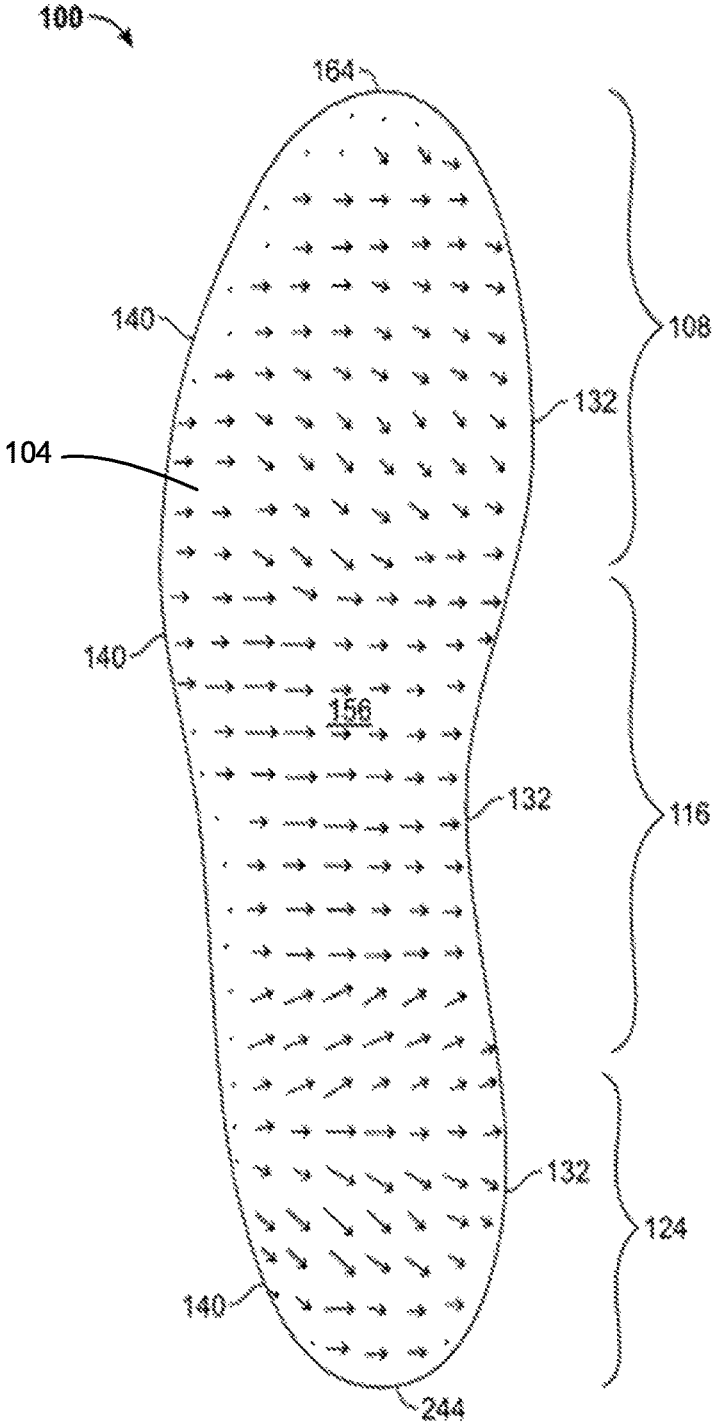
FIG. 1B illustrates a top view of an insole according to various exemplary embodiments showing gradient vectors.

Referring now to FIGS. 1A and 1B simultaneously, therein illustrated is a top view of an insole 100 according to various exemplary embodiments. The insole 100 includes a forefoot portion 108, midfoot portion 116 and rearfoot portion 124. The insole 100 is generally shaped according to the shape of a wearer's foot and can be disposed over the bottom interior surface of a footwear item.

FIG. 1B illustrates a plurality of gradient vectors at various points on the interior surface 104 of the insole 100. As is well known in the art, each gradient vector has a direction component and a magnitude component, which denote respectively the direction and magnitude of the steepest slope at a point (i.e. direction of the greatest rate of increase and the magnitude of the increase). For example, a drop of water at given point on the interior surface 104 would flow downwardly in a direction opposite to the gradient vector corresponding to that point. The speed of the flow of that drop of water would further correspond to the magnitude of the corresponding gradient vector.

The forefoot portion 108 includes a first incliner. The first incliner provides a varying thickness of the forefoot portion 108. For example, a thickness of an inner side 132 of the forefoot portion 108 is greater than a thickness of an outer side 140 of the forefoot portion 108. When the insole 100 is disposed on a bottom interior surface of a footwear item and a wearer's foot is positioned over the insole 100, the varying thickness of the first incliner causes the wearer's foot and leg to be inclined outwardly towards the outer side 140 of the insole 100. The first incliner promotes supination of the foot of the wearer. For example, when the foot is inclined in this way or in the supination position, the tibia of the wearer is also oriented outwardly. For example, when each of the wearer's feet are positioned over respective insoles 100, the left and right tibia of the wearer are oriented away from one another.

The rearfoot portion 124 includes a second incliner. The second incliner provides a varying thickness of the rearfoot portion 124. For example, a thickness of an inner side 132 of the rearfoot portion 124 is greater than a thickness of a thickness of an outer side 140 of rearfoot portion 124. When the insole 100 is disposed on a bottom interior surface of a footwear item and a wearer's foot is positioned over the insole 100, the varying thickness of the second incliner causes the wearer's foot to be inclined outwardly towards the outer side 140 of the insole 100. The second incliner promotes supination of the foot of the wearer. For example, when the foot is inclined in this way or in the supination position, the tibia of the wearer is also oriented outwardly. For example, when each of the wearer's feet is positioned over respective insoles 100, the left and right tibia of the wearer are oriented away from one another.

According to various exemplary embodiments, the first incliner of the forefoot portion includes an at least partially tapered portion being tapered from the inner side 132 of the insole 100 towards the outer side 140 of the insole 100. As a result of the at least partially tapered portion, the thickness of a region of the forefoot portion 108 near its inner side 132 is greater than the thickness of a region of the forefoot portion 108 near its outer side 140.

Figure 3:
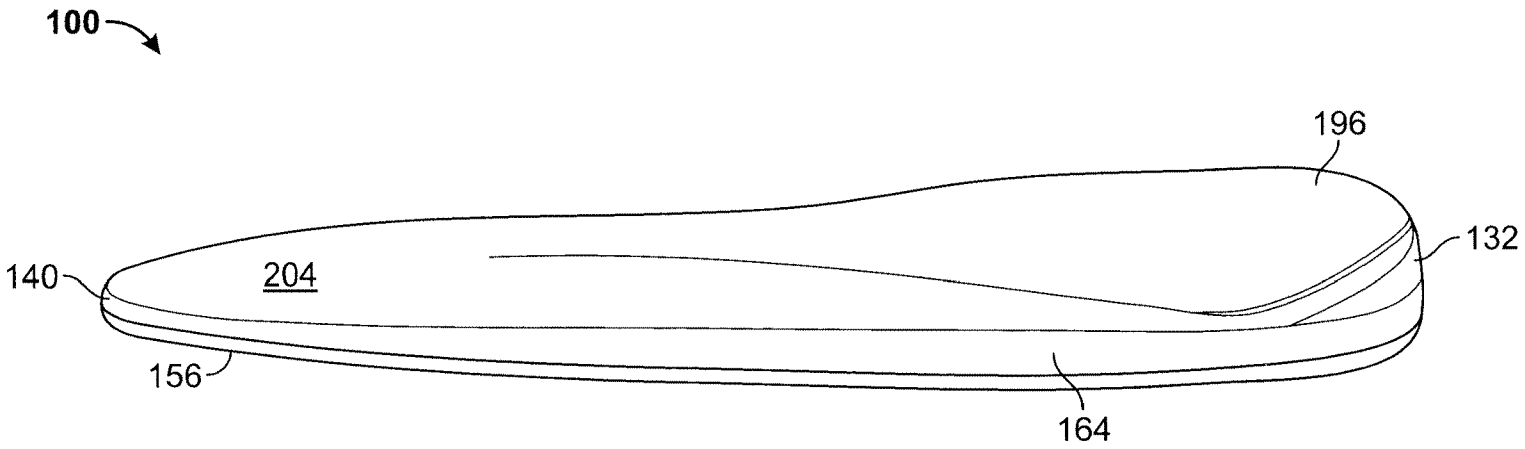
FIG. 3 illustrates an elevation view of a front side of an insole according to various exemplary embodiments.

Referring now to FIG. 3, therein illustrated is a front elevation view of the insole 100 according to various exemplary embodiments. When placed on a flat underlying surface, the incliner of the forefoot portion 108 causes a height above the underlying surface of a region of the top surface 156 corresponding to the region of the forefoot portion 108 near its inner side 132 to be greater than a height above the underlying surface of a region of the top surface 156 corresponding to the region of the forefoot portion 108 near its outer side 140.

According to various exemplary embodiments, the at least partially tapered portion of the forefoot portion 108 is spaced apart from a front end 164 of the insole 100. Accordingly a thickness of the forefoot portion 108 at its inner side 132 at a location spaced apart from the front end 164 is greater than a thickness of the forefoot portion 108 at its front end 164. For example, when the insole 100 is disposed on a bottom interior surface of footwear item and a wearer's foot is positioned over the insole 100, this difference in thickness causes the wearer's foot to also be slightly inclined towards the front end 164. This forward inclination of the foot further promotes linear movement of the wearer's knee.

For example, the at least partially tapered portion of the forefoot portion 108 extends in a side-to-side direction from the inner side 132 of the insole 100 to a location intermediate the inner side 132 and the outer side 140. Accordingly, a thickness of the forefoot portion 108 gradually decreases from the inner side 132 to the location intermediate the inner side 132 and the outer side 140 corresponding to an edge of the at least partially tapered portion. A thickness of the forefoot portion 108 from the edge of the at least partially tapered portion to the outer side 140 may be substantially constant.

According to various exemplary embodiments, a thickness of proximal hallux portion 172 of the forefoot portion 108 is greater than a thickness of the distal hallux portion 180 of the forefoot portion 108. For example, the at least partially tapered portion of the forefoot portion 108 may at least partially extend into (i.e. partially overlap with) the proximal hallux portion 172 of the forefoot portion 108 while being spaced apart from the distal hallux portion 180. For example, when the insole 100 is disposed on a bottom interior surface of footwear item and a wearer's foot is positioned over the insole 100, this difference in thickness between the proximal hallux portion 172 and distal hallux portion 180 causes the wearer's foot to also be slightly inclined towards the front end 164.

According to various exemplary embodiments, the thickness of the distal hallux portion 180 is substantially equal to at least a distal fifth phalanx portion 188 of the forefoot portion 108. For example, the thickness of distal portions of the second to fifth phalanges may be substantially equal. For example, a thickness of the front end 164 of the insole 100 corresponding to the distal ends of the five toes of a wearer's foot placed over the insole may be substantially equal. For example, by having substantially equal thickness for the distal ends of toes of the wearer, a flat position of the front ends of the toes of the wearer's foot is promoted.

Figure 2:
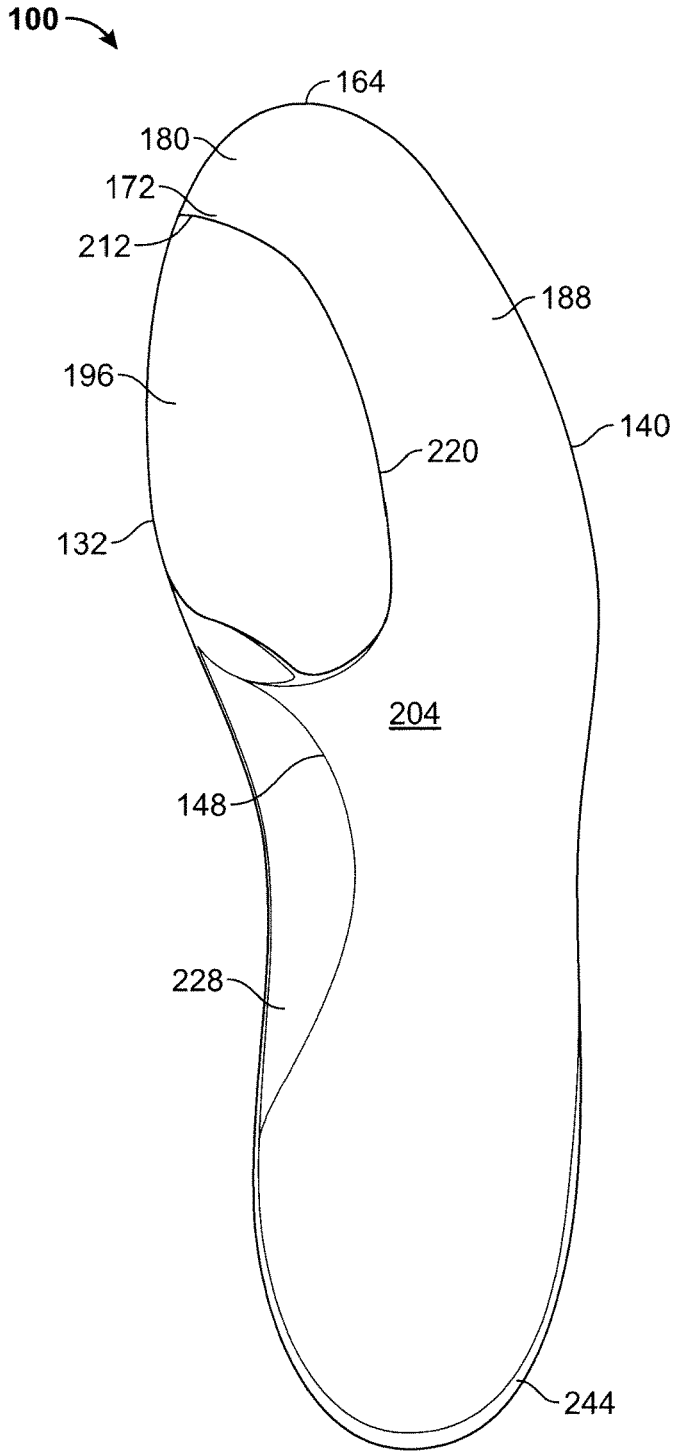
FIG. 2 illustrates a bottom view of an insole according to various exemplary embodiments.
Figure 4:
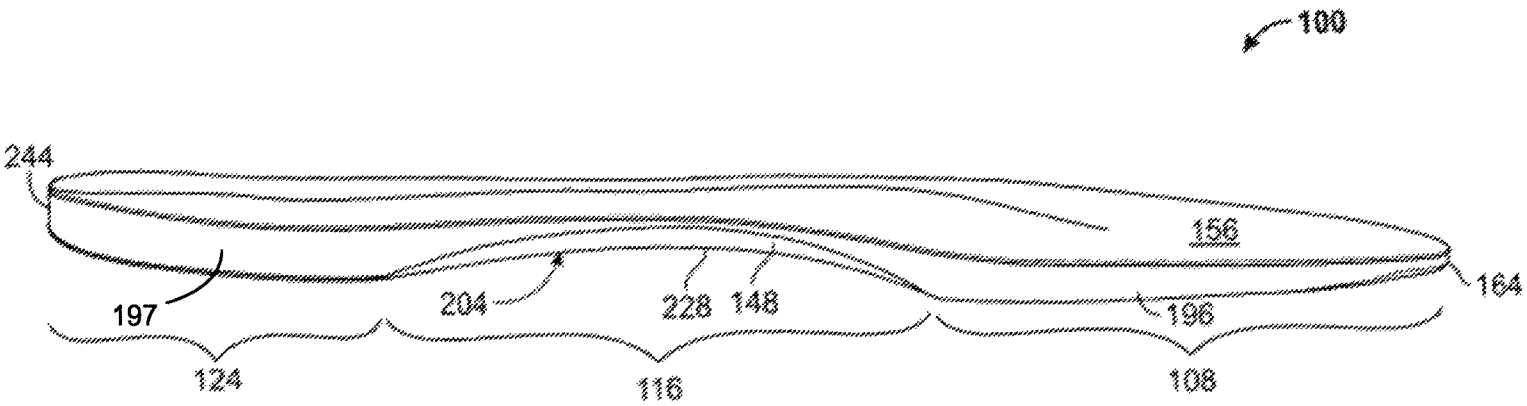
FIG. 4 illustrates an elevation view of an inner side of an insole according to various exemplary embodiments.

Referring now to FIG. 2 to FIG. 4, the incliner of the forefoot portion 108 includes a wedge 196 provided on an underside 204 of the insole proximate to an inner side 132 of the insole 100. As shown in FIG. 2, a front edge 212 of the wedge 196 may be spaced apart from a front end 164 of the insole 100. As shown in FIG. 2, a longitudinal edge 220 of the wedge 196 may be spaced apart from the outer side 140 of the insole 100. For example, the wedge 196 may be tapered from the inner side 132 of the insole 100 towards the outer side 140 and its longitudinal edge 220. For example, the wedge 196 may be further tapered towards the front end 164 of the insole and its front edge 212. For example, the combination of the tapering of the wedge 196 towards the front end 164 and outer side 140 provides a gradual decrease of the thickness of the forefoot portion 108 towards the front and outer sides of the insole 100.

According to various exemplary embodiments, the wedge 196 is integrally formed with the underside 204 of the insole 100. For example, where the insole 100 is fabricated by molding, the molding may include a recess corresponding to the wedge 196 so that the insole member formed from the molding includes the wedge 196.

According to various alternative exemplary embodiments, the wedge 196 is connected to the underside 204 of the insole 100. For example, the wedge 196 and the insole 100 may be discrete members being connected together.

Continuing with FIGS. 2 to 4, the insole 100, the arch 148 is shown to extend from an underside 204 of the insole. For example, the position of the arch 148 corresponds to an arch of the wearer's foot. For example, the arch 148 can define a recess 228 in the underside of the insole 100. The recess 228 may extend from the inner side 132 towards the outer side 140 to a second location 236 intermediate the inner side 132 and the outer side 140. The recess 228 may be shaped according to a midfoot protruding arch of the sport footwear in which the insole 100 is to be inserted. For example, when inserted into the sport footwear and disposed over the bottom interior surface thereof, the midfoot protruding arch may be received within the recess 228 and at least the arch 148 of the midfoot portion 116 is supported by the protruding arch of the footwear.

As described above, the arch 148 causes a portion of the top side 156 of the midfoot portion 116 to be raised with respect to the forefoot portion 108 and rearfoot portion 124. For example, when the insole 100 is placed over a flat underlying surface, a region of the midfoot portion 116 proximate the inner side 132 of the insole 100 can have a greater height above the underlying surface than the height above the underlying surface of a region of the midfoot portion 116 proximate the outer side 140 of the insole 100. Accordingly, the height of the topside 156 of the midfoot portion 116 relative to the underlying surface may be gradually decreasing in a direction from the inner side 132 towards the outer side 140. When the insole 100 is disposed on an inner bottom surface of a footwear item and a wearer's foot is positioned over the insole 100, the gradually decreasing height of the topside 156 promotes outwardly inclination and/or supination of the wearer's foot.

For example, a height of a first metatarsal portion of the midfoot portion 116 is greater than a height of a fifth metatarsal portion of the midfoot portion 116.

For example, a height of a first metatarsal portion, a height of a second metatarsal portion, and a thickness of a third metatarsal portion of the midfoot portion are each greater than a height of the fifth metatarsal portion of the midfoot portion 116.

According to various exemplary embodiments, a height of a region of the topside 156 of the insole 100 proximate the inner side 132 of the midfoot portion 116 is greater than the height of a region of the topside 156 of the insole 100 proximate the inner side 132 of the forefoot portion 108. For example, when the insole 100 is disposed on an inner bottom surface of footwear item and a wearer's foot is positioned over the insole 100, this difference in height between the inner side 132 of the forefoot portion 108 and the inner side of the midfoot portion 116 causes the wearer's foot to also be slightly inclined towards the front end 164.

According to various exemplary embodiments, the second incliner of the rearfoot portion 124 includes an at least partially tapered portion being tapered from the inner side 132 of the insole 100 towards an outer side 140 of the insole 100. As a result of the at least partially tapered portion, the thickness of a region of the rearfoot portion 124 near its inner side 132 is greater than the thickness of a region of the rearfoot portion 124 near its outer side 140.

Figure 5:
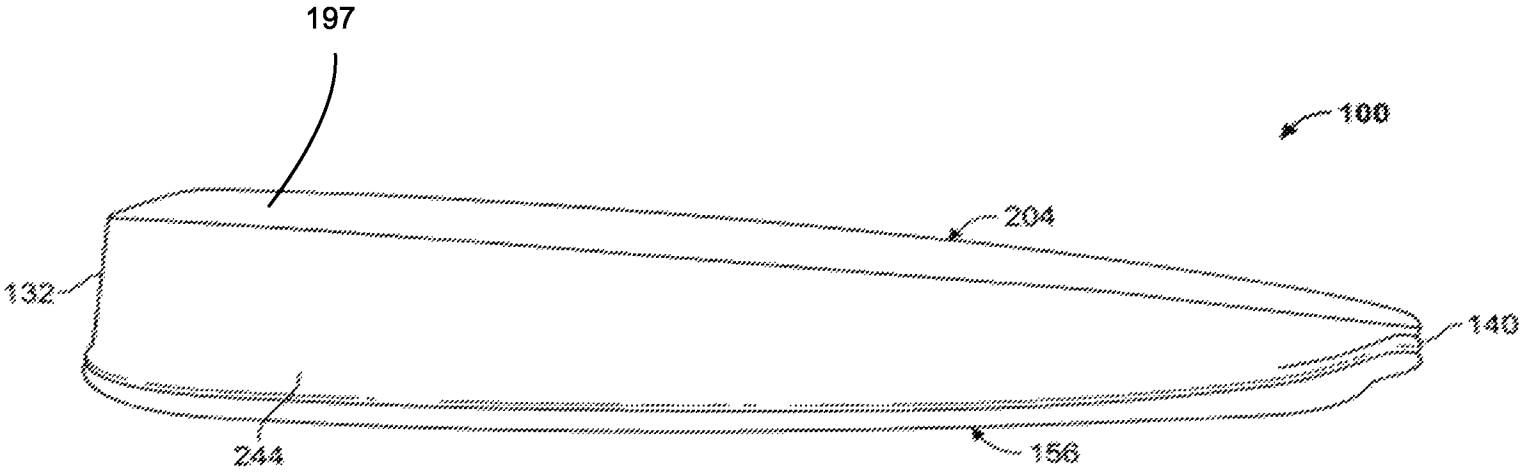
FIG. 5 illustrates an elevation view of a rear side of an insole according to various exemplary embodiments.

Referring now to FIG. 5, therein illustrated a rear elevation view of the insole 100 according to various exemplary embodiments. When placed on a flat underlying surface, the second incliner of the rearfoot portion 124 causes a thickness of a region of the rearfoot portion 124 near its inner side 132 to be greater than thickness of a region of the rearfoot portion 124 near its outer side 140.

According to various exemplary embodiments, at least a region of the tapered portion of the rearfoot portion 124 proximate the rear end 244 of the insole extends continuously from the inner side 132 to the outer side 140.

According to various alternative exemplary embodiments, the at least partially tapered portion of the rearfoot portion 124 extends in a side-to-side direction from the inner side 132 of the insole 100 to a location intermediate the inner side 132 and the outerside 140. Accordingly, a thickness of the rearfoot portion 124 gradually decreases from the inner side 132 to the location intermediate the inner side 132 and the outer side 140 corresponding to an edge of the at least partially tapered portion of the second incliner of the rearfoot portion 124.

Figure 6:
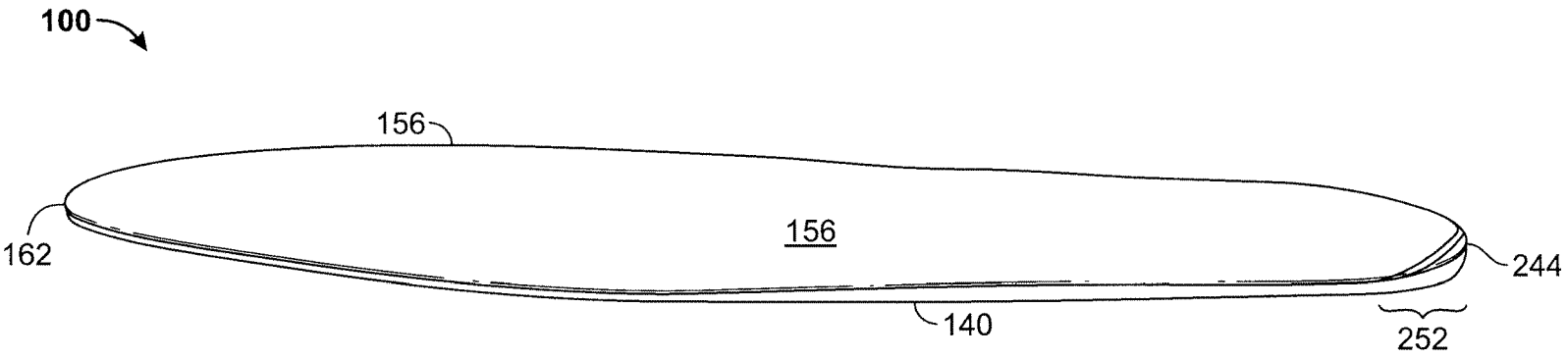
FIG. 6 illustrates an elevation view of an outer side of an insole according to various exemplary embodiments.
Figure 7:
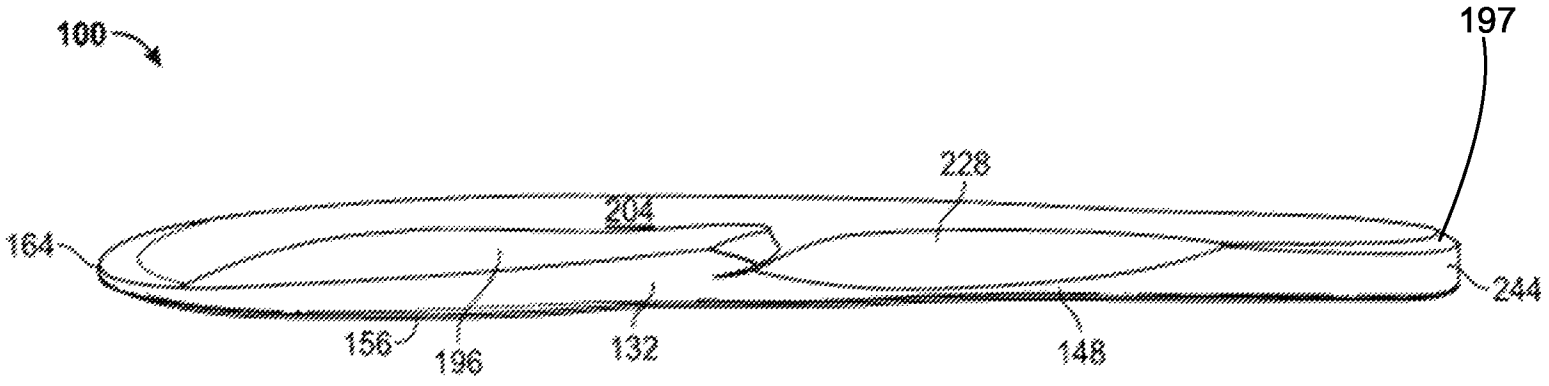
FIG. 7 illustrates an elevation view of an inner side of an insole according to various exemplary embodiments placed in an upside-down orientation.
Figure 8:
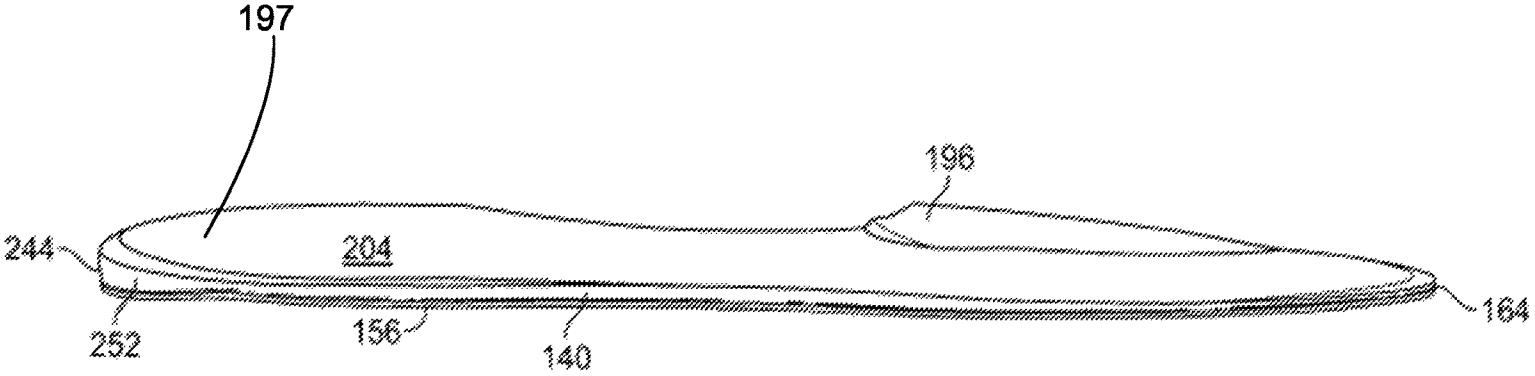
FIG. 8 illustrates an elevation view of an outer side of an insole according to various exemplary embodiments placed in an upside-down orientation.

Referring now to FIG. 6, therein illustrated is a side elevation view of an outer side of the insole 100 according to various exemplary embodiments. For example, and as illustrated in FIG. 6, at least a region of the tapered portion of the rearfoot portion 124 proximate the outer side 140 of the insole may be further tapered from the rear end 244 of the insole 100 towards the front end 164 of the insole 100. Accordingly, when the insole 100 is disposed on a bottom interior surface of a footwear item and a wearer's foot is positioned over the insole 100, the forward tapering of the outer side 140 of the second incliner 252 of the rearfoot portion 124 promotes the forward inclination of the outside of the foot, which further promotes linear movement of the wearer's knee.

Referring back to FIG. 4, according to various exemplary embodiments, a region of the rearfoot portion 124 proximate the inner side 132 of the insole 100 and extending from the rear end 244 to the midfoot portion 116 may have a substantially constant thickness.

Continuing with FIG. 4, according to various exemplary embodiments, a thickness of a region of the rearfoot portion 124 proximate the rear end 244 of the insole 100 is greater than a hallux portion of the forefoot portion 108. For example, this region of the rearfoot portion 124 corresponds to a calcaneus of the wearer's foot. Accordingly, when the insole 100 is disposed on an inner bottom surface of a footwear item and a wearer's foot is positioned over the insole 100, the difference in thickness behind the region of the rearfoot portion 124 and the hallux portion of the forefoot portion 108 promotes the forward inclination of the outside of the foot, which further promotes linear movement of the wearer's knee.

According to various exemplary embodiments, the incliner of the rearfoot portion 124 includes a second wedge provided on an underside 204 of the insole 100 proximate to an inner side of the insole 100. For example, the second wedge may be tapered from the inner side 132 of the insole 100 to the outer side 140 where the rearfoot portion 124 has a front rearfoot portion and a rearward rearfoot portion. The front rearfoot portion is in-between the midfoot portion and the rearward rearfoot portion. The front rearfoot portion is tapered from the inner side 132 of the insole 100 to the outer side 140 of the insole 100 and from a front end of the front rearfoot portion towards a rear end 244 of the insole 100 and the rearward rearfoot portion is tapered from the inner side 132 of the insole 100 to the outer side 140 of the insole 100 and from the rear end 244 of the insole 100 towards the front rearfoot portion.

According to various exemplary embodiments, the second wedge of the second incliner of the rearfoot portion is integrally formed with the underside 204 of the insole 100. For example, where the insole 100 is fabricated by molding, the molding may include a second recess corresponding to the second wedge so that the insole member formed from the molding includes the second wedge of the incliner of the rearfoot portion 124.

According to various alternative exemplary embodiments, the second wedge is connected to the underside 204 of the insole 100. For example, the second wedge and the insole 100 may be discrete members being connected together.

While the above has been described generally with respect to sport footwear, it will appreciated that the insole can be adapted for specific types of sports footwear. In particular those footwear for sports where balancing on one leg is required and/or linear movement of the knee of the balancing leg is beneficial.

According to various exemplary embodiments, the insole 100 is for sport footwear that is an ice skate, such as for figure skating, hockey, or speed skating.

According to various exemplary embodiments, the insole 100 is for sport footwear that is an ice hockey skate.

According to various exemplary embodiments, the insole 100 is for sport footwear that is a roller skate.

According to various exemplary embodiments, the insole 100 is for sport footwear that is a boot for downhill skiing.

According to various exemplary embodiments, the insole 100 is for sport footwear that is a boot for cross-country skiing.

The person skilled in the art would understand that the various properties or features presented in a given embodiment can be added and/or used, when applicable, to any other embodiment covered by the general scope of the present disclosure.

The present disclosure has been described with regard to specific examples. The description was intended to help the understanding of the disclosure, rather than to limit its scope. It will be apparent to one skilled in the art that various modifications can be made to the disclosure without departing from the scope of the disclosure as described herein, and such modifications are intended to be covered by the present document.

The invention claimed is:

1. An insole for a sport footwear, the insole comprising:

a forefoot portion comprising a forefoot wedge for inclining a foot of a wearer towards an outer side of the insole, the forefoot portion having a proximal hallux portion, a distal hallux portion and a front end, the front end dimensioned to be placed beneath a distal end of toes of the wearer wearing the insole;

a midfoot portion having a longitudinal arch comprised within an underside of the insole, the arch defining a recess on the underside of the insole, the recess extending laterally from an inner side of the insole to a second location intermediate the inner side and the outer side of the insole, the recess being dimensioned to receive a protruding arch of the sport footwear; and a rearfoot portion comprising a rearfoot wedge for inclining the foot of the wearer towards the outer side of the insole, the rearfoot portion having a front rearfoot portion and a rearward rearfoot portion, the front rearfoot portion being in-between the midfoot portion and the rearward rearfoot portion, the front rearfoot portion being tapered from the inner side of the insole to the outer side of the insole and from a front end of the front rearfoot portion towards a rear end of the insole, the rearward rearfoot portion being tapered from the inner side of the insole to the outer side of the insole and from the rear end of the insole towards the front rearfoot portion;

wherein a first thickness of the proximal hallux portion of the forefoot portion is greater than a second thickness of the distal hallux portion of the forefoot portion and a difference between the first thickness and the second thickness is configured to incline the forefoot portion towards the front end to promote linear movement of a knee of the wearer.

2. The insole of claim 1, wherein the forefoot wedge of the forefoot portion comprises an at least partially tapered portion from the inner side of the insole towards the outer side of the insole.

3. The insole of claim 2, wherein the at least partially tapered portion of the forefoot portion is spaced apart from a front end of the insole.

4. The insole of claim 2, wherein the at least partially tapered portion extends from the inner side of the insole to a location intermediate the inner side and the outer side.

5. The insole of claim 2, wherein the forefoot wedge is tapered towards the front end of the insole.

6. The insole of claim 1, wherein a first metatarsal height of a first metatarsal portion of the midfoot portion is greater than a fifth metatarsal height of a fifth metatarsal portion of the midfoot portion.

7. The insole of claim 6, wherein a midfoot height of the inner side of the midfoot portion is greater than a forefoot height of the inner side of the forefoot portion.

8. An insole for a sport footwear, the insole comprising:

a forefoot portion comprising a forefoot wedge for promoting supination of a foot of a wearer, the forefoot portion having a proximal hallux portion, a distal hallux portion and a front end, the front end dimensioned to be placed beneath a distal end of toes of the wearer wearing the insole;

a midfoot portion having a longitudinal arch comprised within an underside of the insole, the arch defining a recess adapted to receive a protruding arch of the sport footwear; and a rearfoot portion comprising a rearfoot wedge for promoting supination of the foot of the wearer, the rearfoot portion having a front rearfoot portion and a rearward rearfoot portion, the front rearfoot portion being in-between the midfoot portion and the rearward rearfoot portion, the front rearfoot portion being tapered from the inner side of the insole to the outer side of the insole and from a front end of the front rearfoot portion towards a rear end of the insole, the rearward rearfoot portion being tapered from the inner side of the insole to the outer side of the insole and from the rear end of the insole towards the front rearfoot portion;

wherein a first thickness of the proximal hallux portion of the forefoot portion is greater than a second thickness of the distal hallux portion of the forefoot portion and a difference between the first thickness and the second thickness is configured to incline the forefoot portion towards the front end to promote linear movement of a knee of the wearer.

9. An insole for an ice skate, the insole comprising:

a forefoot portion comprising a forefoot wedge for inclining a foot of a wearer towards an outer side of the insole, the forefoot portion having a proximal hallux portion, a distal hallux portion and a front end, wherein a the front end of the forefoot portion is dimensioned to be placed beneath a distal end of toes of the wearer wearing the insole;

a midfoot portion having a longitudinal arch comprised within an underside of the insole, the arch defining a recess on the underside of the insole, the recess being dimensioned to receive a protruding arch of the ice skate; and a rearfoot portion comprising a rearfoot wedge for inclining the foot of the wearer towards the outer side of the insole, the rearfoot portion having a front rearfoot portion and a rearward rearfoot portion, the front rearfoot portion being in-between the midfoot portion and the rearward rearfoot portion, the front rearfoot portion being tapered from an inner side of the insole to the outer side of the insole and from a front end of the front rearfoot portion towards a rear end of the insole, the rearward rearfoot portion being tapered from the inner side of the insole to the outer side of the insole and from the rear end of the insole towards the front rearfoot portion, wherein a first thickness of the proximal hallux portion of the forefoot portion at the inner side at a location spaced apart from the front end is greater than a second thickness of the distal hallux portion of the forefoot portion and a difference between the first thickness and the second thickness is configured to incline the forefoot portion towards the front end to promote linear movement of a knee of the wearer.

10. The insole of claim 9, wherein the forefoot wedge of the forefoot portion comprises an at least partially tapered portion from the inner side of the insole towards the outer side of the insole.

* * * * *